US006526903B2

(12) United States Patent
Robinson et al.

(10) Patent No.: US 6,526,903 B2
(45) Date of Patent: Mar. 4, 2003

(54) HIGH SPEED M-SHAPED BOAT HULL

(75) Inventors: Charles W. Robinson, Santa Fe, NM (US); William F. Burns, III, San Diego, CA (US)

(73) Assignee: Mangia Onda Co., LLC, San Diego, CA (US)

( * ) Notice: Subject to any disclaimer, the term of this patent is extended or adjusted under 35 U.S.C. 154(b) by 0 days.

(21) Appl. No.: 10/186,464

(22) Filed: Jun. 28, 2002

(65) Prior Publication Data

US 2002/0162498 A1 Nov. 7, 2002

Related U.S. Application Data

(63) Continuation-in-part of application No. 09/908,779, filed on Jul. 17, 2001, now abandoned, which is a continuation-in-part of application No. 09/750,368, filed on Dec. 27, 2000, now Pat. No. 6,314,903, which is a continuation-in-part of application No. 09/399,468, filed on Sep. 20, 1999, now Pat. No. 6,250,245.

(60) Provisional application No. 60/101,353, filed on Sep. 22, 1998.

(51) Int. Cl.[7] ..... B63B 1/32; B63B 1/34

(52) U.S. Cl. ..... 114/288; 114/67 A

(58) Field of Search ..... 114/67 R, 67 A, 114/271, 274, 288, 289, 290

(56) References Cited

U.S. PATENT DOCUMENTS 2,989,939 A * 6/1961 Tatter ..... 114/61.32
3,191,572 A * 6/1965 Wilson ..... 440/38
3,902,445 A * 9/1975 Stolk ..... 114/289

* cited by examiner

*Primary Examiner*—S. Joseph Morano
*Assistant Examiner*—Andy Wright
(74) *Attorney, Agent, or Firm*—Loyal McKinley Hanson

(57) ABSTRACT

A watercraft constructed according to the invention includes at least one hull according to the invention described in the grandparent and great-grandparent patent applications that issued as U.S. Pat. Nos. 6,314,903 and 6,250,245, which hull includes first and second channel defining structures connected to the hull that define a first channel on a port side of the hull with a forwardly facing first channel entrance and a second channel on a starboard side of the hull with a second forwardly facing channel entrance. According to one aspect of the invention, the hull has a bow that extends to a vertical knife edge, and the first and second wing channel entrances are arranged to form a near horizontal knife edge at the deck level in order to enhance high speed operations. According to another aspect of the invention, there is provided an onboard air system for injecting air into the first and second channels in order to enhance high speed operation of the watercraft. The air system may include a blower powered by an on-deck auxiliary power unit, a blower powered by a main drive diesel or gas turbine, components that divert excess air from a main drive gas turbine, or components that divert exhaust from a jet engine main drive.

13 Claims, 15 Drawing Sheets

HIGH SPEED M-SHAPED BOAT HULL

CROSS REFERENCES TO RELATED APPLICATIONS

This application is a continuation in part of and commonly assigned parent application by the same inventors having Ser. No. 09/908,779 and Filing Date Jul. 17, 2001 now abandoned, which parent application is a continuation in part of the commonly assigned grandparent application by the same inventors having Ser. No. 09/750,368 and Filing Date Dec. 27, 2000 (now U.S. Pat. No. 6,314,903 issued Nov. 11, 2001), which grandparent application is a continuation in part of the commonly assigned great-grandparent application by the same inventors having Ser. No. 09/399,468 and Filing Date Sep. 20, 1999 (now U.S. Pat. No. 6,250,245 issued Jun. 26, 2001) which great-grandparent application claimed the benefit of the United States Provisional patent application by the same inventors having Ser. No. 60/101,353 and Filing Date Sep. 22, 1998.

BACKGROUND OF THE INVENTION

1. Technical Field

This invention relates generally to boat hulls, and more particularly to a powered watercraft having a boat hull that is similar in some respects to the M-shaped boat hull designed for the suppression of bow waves described in U.S. Pat. Nos. 6,314,903 and 6,250,245.

2. Description of Related Art

The grandparent and great-grandparent applications of this continuation in part application (Ser. Nos. 09/750,368 and 09/399,468 that issued as U.S. Pat. Nos. 6,314,903 and 6,250,245) describe an M-shaped boat hull designed to overcome certain bow wave concerns. In sea trials of a boat embodying such a hull, the act of increasing power to test the advantages of the air planing cushion at higher boat speeds led to the discovery of two new phenomena. First, the horsepower-to-speed ratio increased in an almost linear form indicating that increased air intake with increasing boat speed enhanced the air cushion planing efficiency so as to offset the exponential increase in wave-making drag with increasing boat speed. Second, the boat operated downwind more efficiently at lower boat speeds, but upwind into a 10-knot breeze the boat was propelled at almost 25% greater speed than when operating downwind. Such unexpected characteristics of an M-shaped boat hull promise significant benefits, and so a need exists for ways to develop and exploit those characteristics.

SUMMARY OF THE INVENTION

This invention addresses the need outlined above by providing a watercraft in the form of a boat embodying an M-shaped boat hull design (as we have already patented in U.S. Pat. Nos. 6,250,245 and 6,314,903) that is configured to maximize the volume of air naturally entering the wing channels and to include an air system adapted to inject additional air. So doing, substantially enhances high speed operation and propulsion efficiency and enables a dramatic gain in maximum boat speed.

To paraphrase some of the more precise language appearing in the claims, a watercraft constructed according to the invention includes at least one hull constructed according to the invention as described in our U.S. Pat. Nos. 6,250,245 and 6,314,903. The hull has a fore end, an aft end, a longitudinal axis extending between the fore end and the aft end, and the hull includes a displacement body portion that extends between the fore end and the aft end.

A first channel-defining structure portion of the hull is located on the port side of the displacement body. It includes a first wing structure extending laterally from the port side of the displacement body above the static waterline and a first outer skirt structure that extends downwardly from the first wing structure to below the static waterline in spaced apart relationship to the displacement body. The first outer skirt structure has an outer surface that is substantially perpendicular with respect to the static waterline and the first channel-defining structure defines a first channel with a cross-sectional surface that is generally arcuate.

Similarly, a second channel-defining structure portion of the hull is located on the starboard side of the displacement body. It includes a second wing structure extending laterally from the starboard side of the displacement body above the static waterline and a second outer skirt structure extending perpendicularly downwardly from the second wing structure to below the static waterline in spaced apart relationship to the displacement body. The second outer skirt structure has an outer surface that is substantially perpendicular with respect to the static waterline and the second channel-defining structure defines a second channel with a cross-sectional surface that is generally arcuate.

The first and second channels extend from the fore end to the aft end. The first and second channels are adapted to capture a bow wave and to cause air and water to mix and spiral toward the aft end of the hull as compressed aerated water, thereby reducing friction drag, increasing lateral stability, and dampening transmission of bow wave energy at the aft end of the hull. Those aspects of the watercraft are described and claimed in our U.S. Pat. Nos. 6,314,903 and 6,250,245.

According to a major aspect of the instant invention, the hull has a bow that extends to a vertical knife edge, and the first and second wing channel entrances are arranged to form a near horizontal knife edge at the deck level. That arrangement achieves maximum air flow into the first and wing channels when the watercraft is moving forwardly in order to enhance high speed operation of the watercraft. It improves aerodynamics of the watercraft in order to reduce air resistance during high speed operation of the watercraft. It improves the hydrodynamics at the bow in order to enhance wave piercing during high speed operation of the watercraft. According to another aspect of the invention, there is provided an onboard air system that is adapted to function as means for injecting air into the first and second channels in order to enhance high speed operation of the watercraft. The air system may be configured in any of various ways, including a blower powered by an on-deck onboard or by an auxiliary power unit, a blower powered by a main drive diesel or gas turbine, diverting excess air from a main drive gas turbine, and diverting exhaust from a jet engine main drive.

Thus, the claims for the instant invention are the combination of claims in our patents already issued and added elements directed to the high speed aspects described herein. The instant invention significantly enhances high speed operation of a watercraft embodying an M-shaped boat hull design as we have already patented in U.S. Pat. Nos. 6,250,245 and 6,314,903 by adding structure to a bow-wave capturing hull (i.e., an "M-shaped" hull as that term is used in our already issued patents). The invention improves high speed operation and propulsion efficiencies by (i) increasing the volume of air entering the wing channels, thereby enhancing air cushion pressure for more efficient planing, (ii) increasing the aerodynamics of the bow, thereby reducing air resistance, particularly at high boat speeds (iii)

improving the hydrodynamics at the bow to allow wave piercing at high boat speeds, and (iv) providing supplemental compressed air to the air cushion for increased efficiency and to allow higher boat speeds. The following illustrative drawings and detailed description make the foregoing and other objects, features, and advantages of the invention more apparent.

BRIEF DESCRIPTION OF THE DRAWINGS

FIG. 3A shows twin motors in the wing channels of the boat hull.

FIG. 3B shows twin motors on the displacement body of the boat hull.

FIG. 3C shows a single motor on the displacement hull of the boat hull.

DETAILED DESCRIPTION OF PREFERRED EMBODIMENTS OF THE INVENTION

The following description proceeds by restating some of the information contained in the great-grandparent application that issued as U.S. Pat. No. 6,250,245 while making reference to FIGS. 1–7 as background information in the following M-Shaped Boat Hull section of the specification. Next, a Multi-Hull M-Shaped Boat Hull section of the specification briefly describes watercraft having more than one M-shaped hull with reference to FIGS. 8 and 9 as described in the grandparent application that issued as U.S. Pat. No. 6,314,903. Thereafter follows a description of the preferred embodiments of the present invention in a High Speed M-Shaped Boat Hull section of the specification with reference to FIGS. 10–16. A reader already familiar with the information described in the grandparent and great-grandparent applications that issued as U.S. Pat. Nos. 6,314,903 and 6,250,245 can skip directly to the High Speed M-Shaped Boat Hull section.

M-Shaped Boat Hull. The invention described in the grandparent and great-grandparent applications that issued as U.S. Pat. Nos. 6,314,903 and 6,250,245 is predicated on the realization that a boat propelled by motor or sail generates bow waves containing energy. With a conventional hull design, this energy is not only lost, thereby reducing efficiency, but also threatens other boats and damage to structures at the water/land interface. The "M-shaped" hull described and claimed in the grandparent and great-grandparent applications and the resulting patents recaptures the bow waves not only to protect other boats and structures at the water/land interface, but also to enhance boat efficiency. In the following detailed description, certain preferred embodiments of the M-shaped hull are described structurally first and then the general operation is provided.

Figure 1:
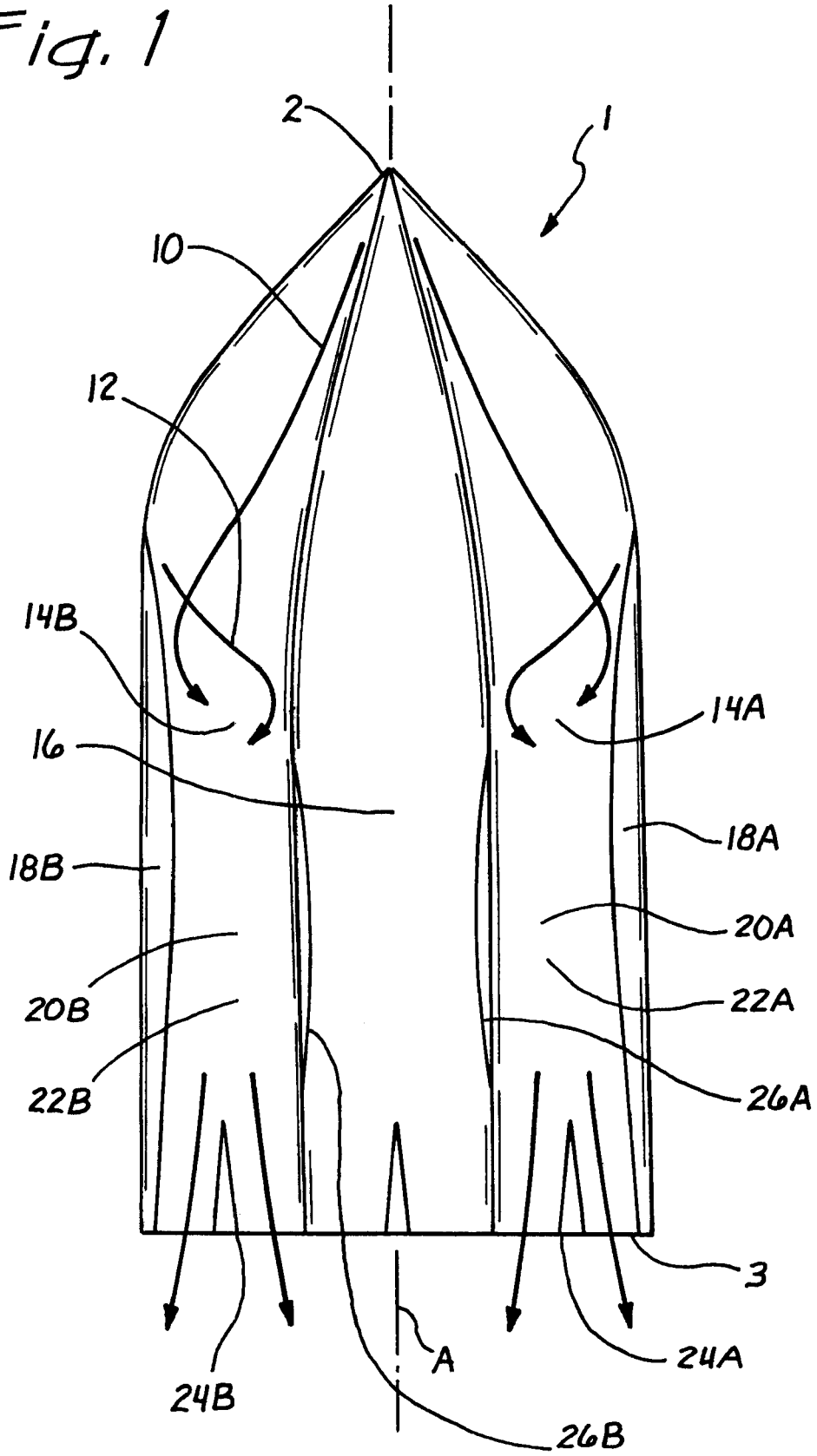
FIG. 1 shows a plan view of an M-shaped boat hull designed according to the invention described in the great-grandparent patent application that issued as U.S. Pat. No. 6,250,245, depicting large bow waves, small skirt waves, planing wings, "spiral channel" sections on the planing wings, a central displacement body, tapered outer and inner skirts, wing channels formed in the planing wings, and hydrodynamic serrations, both on the central displacement body and in the wing channels.
Figure 2:
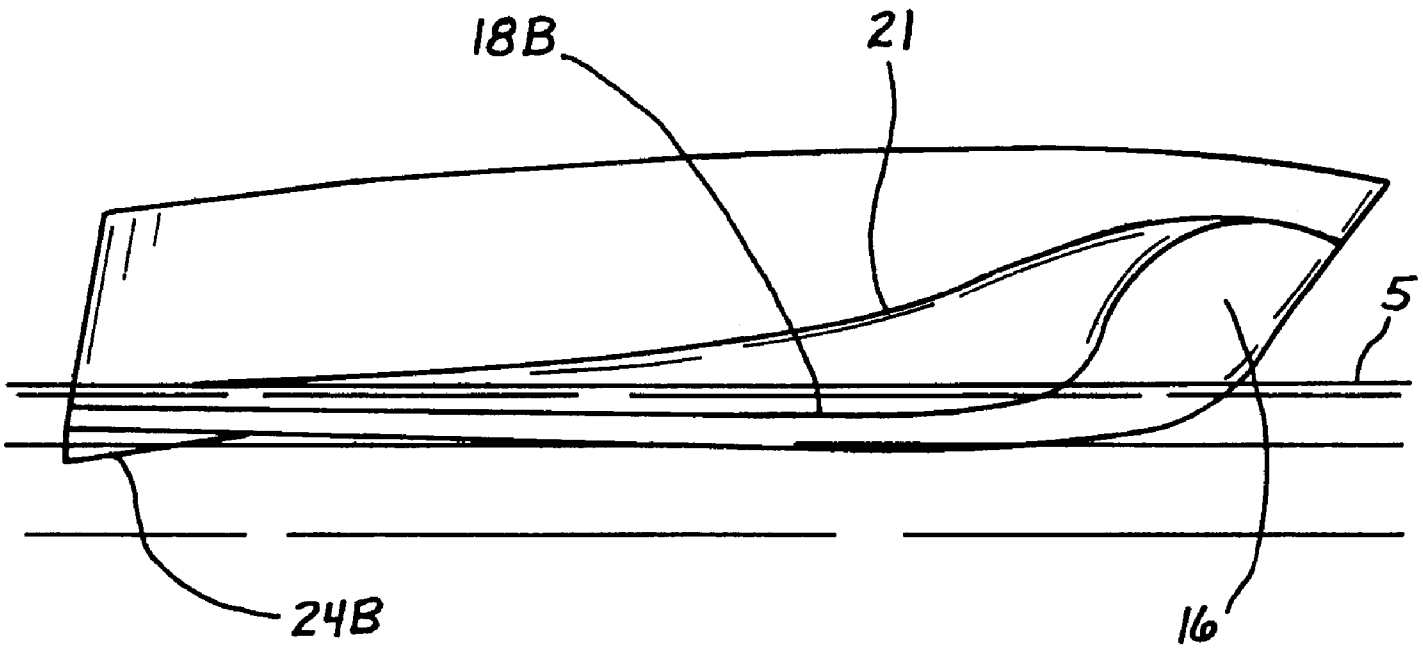
FIG. 2 shows a boat hull profile, depicting a central displacement body and tapered outer skirts that capture the bow wave, and the line of the planing wings that suppress and recapture wave energy.

Referring initially to FIGS. 1 and 2, they show a watercraft in the form of powerboat comprising an "M-shaped" hull 1 having a fore end 2, an aft end 3, and a longitudinal axis (designated by a reference number A in FIG. 1) extending between the fore end 2 and the aft end 3. The hull 1 includes a displacement body 16, which is preferably relatively narrow and centralized, and two downwardly extend outer skirts in the form of a port skirt 18A and a starboard skirt 18B. The outer skirts 18A and 18B are preferably generally parallel. The displacement body 16 provides displacement lift for efficient operation at low speeds. The outer skirts 18A and 18B are located on either side of the displacement body 16, the port skirt 18A being located on a port side of the displacement body 16 and the starboard skirt 18B being located on a starboard side of the displacement body 16 as illustrated in FIG. 1. Lateral extensions of the watercraft deck outward from the central displacement body 16 form two planing wings, a port planing wing 20A and a starboard planing wing 20B. The planing wing line 21 is shown in FIG. 2. The outer skirts 18A and 18B are connected to the displacement body 16 by the planing wings 20A and 20B to form first and second channel-defining structures that define first and second (i.e., port and starboard) wing channels 14A and 14B. The bow waves 10 and the smaller skirt waves 12 are directed into port and starboard wing channel entrances 6 and 7 of the wing channels 14A and 14B (FIG. 1), wherein the waves undergo spiral action. The starboard wing channel entrance 6 is also identified in FIG. 2.

The outer (i.e., outboard) surfaces of the outer skirts 18A and 18B are preferably substantially perpendicular with respect to the static waterline 5 (FIG. 2) to minimize wave generation. The outer skirts 18A and 18B are also preferably generally arcuate (i.e., curved) on their inner surfaces (i.e., inboard), so as to form arcuate wing channels 14A and 14B with the displacement body 16. Most preferably, the outer skirts 18A and 18B are tapered. In operation, the wing channels 14A and 14B recapture the bow waves 10, thereby protecting other boats and waterway walls and providing effective planing surfaces 22A and 22B for efficient operation at high speed.

In preferred embodiments (see FIGS. 3A–C), the cross-sectional surface of each wing channel 14A and 14B is concave with respect to the static waterline 5. More preferably, the cross-sectional surface of each wing channel 14A and 14B at the fore end 2 is generally arcuate. Preferably, the curvature of the cross-sectional surface of each wing channel 14A and 14B is greater at the fore end 2 than at the aft end 3. The curvature preferably progressively decreases from the fore end 2 to the aft end 3. In particularly preferred embodiments, the cross-sectional surface of each wing channel 18A and 18B is generally arcuate at the fore end 2 and generally linear (i.e., "flat") at the aft end 3. The wing channel ceilings 30A and 30B (i.e., apices) are above the static waterline 5 in the fore end 2 and extend downward below the static waterline 5 in the aft end 3.

Referring again to FIG. 1, the watercraft may have a hull 1 that further comprises two or more downwardly extending inner skirts (a port inner skirt 26A and a starboard inner skirt 26B) attached to either side of the displacement body 16, wherein the outer skirts 18A and 18B flank the inner skirts 26A and 26B. In certain embodiments, as described in greater detail below, these inner skirts 26A and 26B can reduce cavitation caused by propeller action.

Preferably, the hull 1 further comprises one or more hydrodynamically-shaped serrations 24A and 24B located on the surface of the wing channels 14A and 14B (at the aft end 3) and extending downward below the static waterline 5 (FIG. 1). The one or more serrations are preferably located on the wing channel ceiling (see reference numerals 30A and 30B in FIGS. 3A–C). Alternatively, the hull may further comprise one or more hydrodynamic serrations 25 (FIG. 1) located on the surface of the displacement body 16 and extending downward below the static waterline 5. The serrations 24A, 24B, and 25 provide wake control. To more effectively disperse both the remaining bow wave energy exiting from the wing channels 14A and 14B and the propeller wake energy, the hydrodynamically-shaped serrations are preferably mounted under, and extend forward of, the transom which is generally aligned with the outer and inner skirts and propeller(s) discharge. This design disperses the wave flow and increases the mixing of air and water, with the air dampening the transmission of energy in the water, thereby further reducing the threat to other boats or damage to structures at the water/land interface.

There is provided in certain embodiments a watercraft wherein upon forward movement of the watercraft through a body of water, the waves generated by the displacement body 16 and the outer skirts 18A and 18B are substantially directed into the wing channels 14A and 14B, resulting in substantial wave suppression.

Figure 3A:
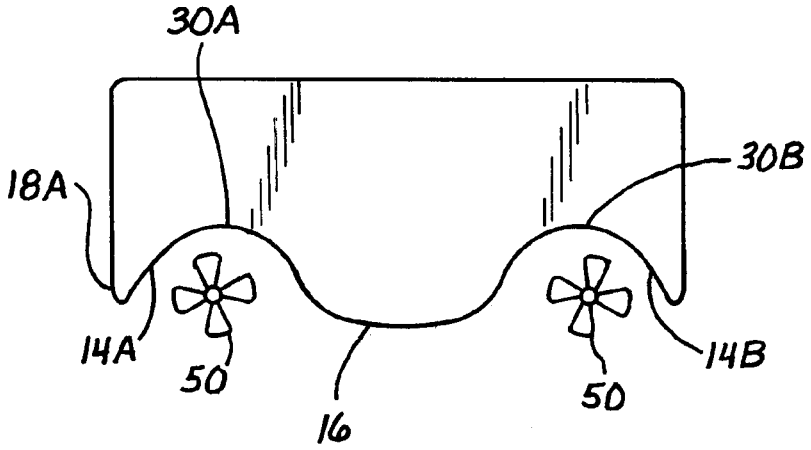
FIGS. 3A–C show the boat hull section, depicting the central displacement body with wing channels and tapered outer skirts to capture and suppress the bow wave.
Figure 3B:
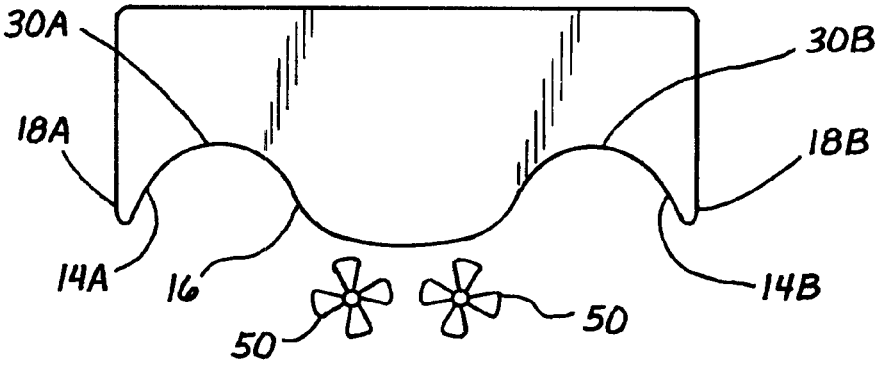
Figure 3C:
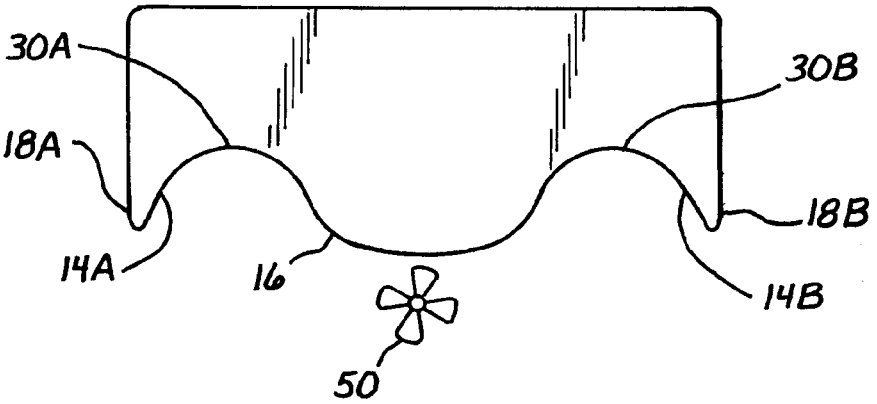

The watercraft may be a powerboat (as illustrated in FIGS. 1, 2, and 3A–C) or a sailboat (as illustrated in FIGS. 4, 5, 6A–C, and 7). Where the watercraft is a powerboat, the watercraft preferably comprises a mechanical propulsion system. The mechanical propulsion system may be an internal combustion system, an electrical system, a compressed air system, a water jet system, or a combination thereof. Preferably, the mechanical propulsion system comprises one or more propellers. Referring to FIGS. 3A–C, the propeller (s) 50 may be located on the displacement body 16 (see FIGS. 3B and 3C) or on a planing wing (e.g., in a wing channel). In the case where the propellers are located in the wing channels (see FIG. 3A), it is preferred that there be two propellers, wherein each of the two propellers is located in a wing channel 14A or 14B.

Twin propellers 50 mounted below the wing channels 14A and 14B provide efficient propulsion and maneuvering at lower speeds, as in FIG. 3A. However, with increased speeds, the turbulent air/water mixture, which is desirable for lift efficiency in the wing channels 14A and 14B, also creates propeller cavitation. To resolve this cavitation problem, the air/water mixture flowing through the wing channels 14A and 14B can be isolated for increased lift efficiency by installing two inner skirts 26A and 26B (preferably generally perpendicular to the static waterline 5 and parallel to the outer skirts 18A and 18B), as illustrated in FIG. 1. Preferably, the inner skirts 26A and 26B are faired into the central displacement body 16 near the point of its maximum beam and extend beyond the propeller(s), thereby forming an inner wall to contain the air/water mixture. This inner skirt design assures solid water flow under the central displacement body 16 in which either a single (see FIG. 3C) or twin propellers (see FIG. 3B) may operate efficiently at higher speeds without cavitation. For propellers mounted on the central displacement body 16, satisfactory boat maneuvering may be achieved with a large single rudder directly aft of a single propeller or twin rudders mounted in the discharge from the two propellers, in either case mounted forward of the transom. Alternatively, where two propellers are used, maneuverability may be controlled by separate control of speed and direction of rotation for each propeller.

In operation, the bow waves 10, which are moved forward by the boat at its speed, are forced into the wing channels 14A and 14B and given a spiral motion by the concave surface of the wing channels 14A and 14B. The water then spirals back through the wing channels with reduced angularity as its forward speed is slowed by friction. Air near the entrances to the wing channels, increasing in pressure with boat speed, is entrapped in the water spiral which acts as screw conveyor, moving the air with the water in a spiral pattern through approximately the first two-thirds of the length of the wing channels 14A and 14B referred to as the "spiral section." Although its speed is reduced by friction, the air/water mixture continues to move forward in relation to water outside the wing channels. This water action contributes to efficient planing lift of the ceilings of the wing channels, with the air content also providing a benefit in reduced friction drag.

As the air/water mixture leaves the "spiral section" (see reference numeral 14 in FIG. 1), it passes into the final approximately one-third of the wing channel that, in certain preferred embodiments, becomes increasingly rectangular with a flattening (e.g., decreased curvature) of the wing channel ceiling. The wing channel ceilings slope downward to below the static waterline 5, reducing and ultimately eliminating the cross-sectional area, thereby increasing the pressure of the air/water mixture. These changes in what is referred to as the "pressure section" (see reference numerals 22A and 22B in FIG. 1) eliminate the spiral flow and force separation of the air which rises towards the wing channel ceiling due to its lower specific gravity. The water, under increasing pressure, compresses the air layer at the wing channel ceiling, thereby providing efficient low-drag planing lift. Finally, the compressed air/water mixture exits under the transom as low energy foam, while the lower solid water layer, from which much of the energy has been extracted in compressing the air, exits the transom below the foam.

Figure 4:
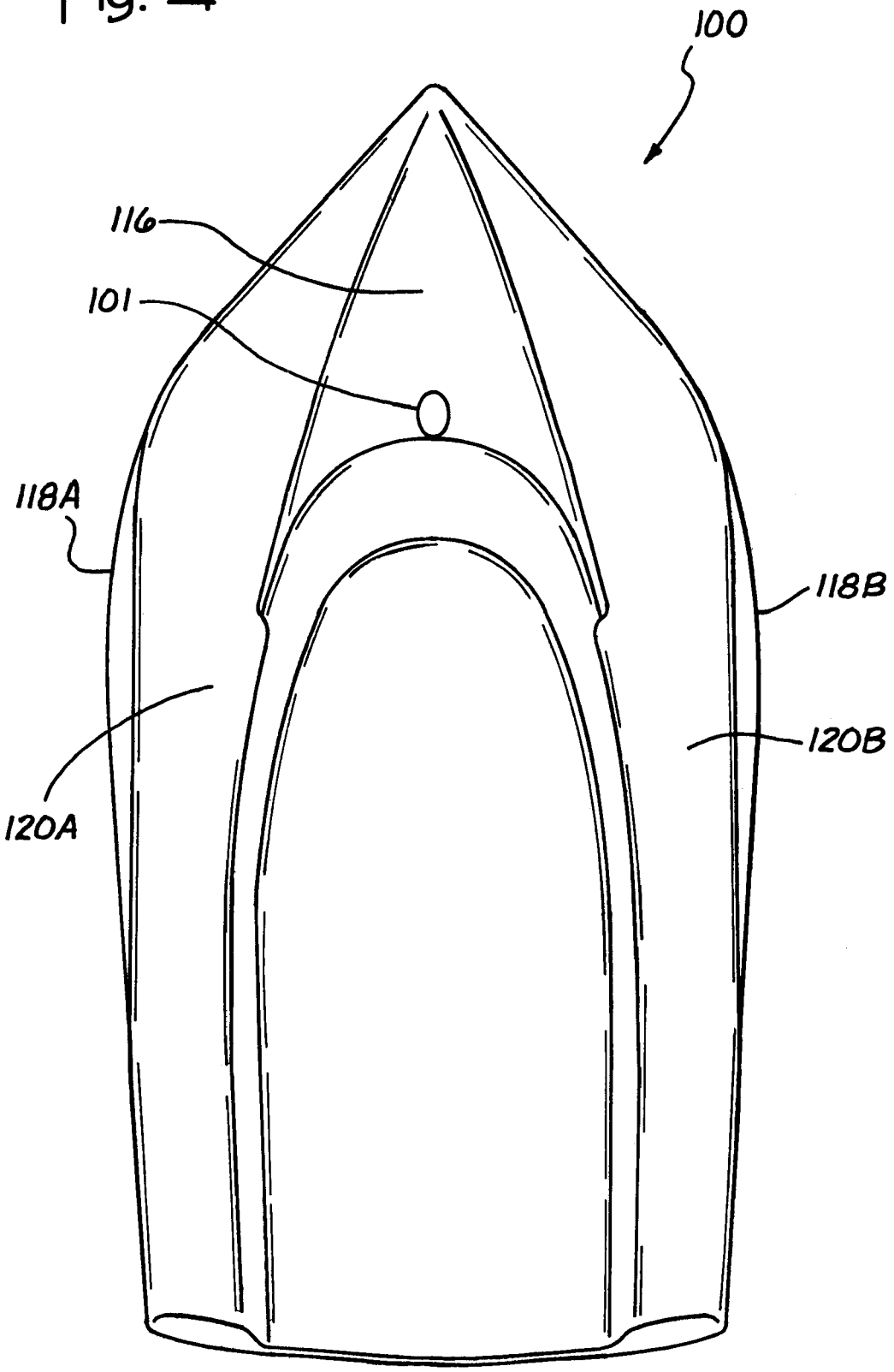
FIG. 4 shows a plan view of an M-shaped sailboat hull designed according to the invention described in the great-grandparent patent application that issued as U.S. Pat. No. 6,250,245, depicting a central displacement body, planing wings and tapered skirt for side force and bow wave capture.
Figure 5:
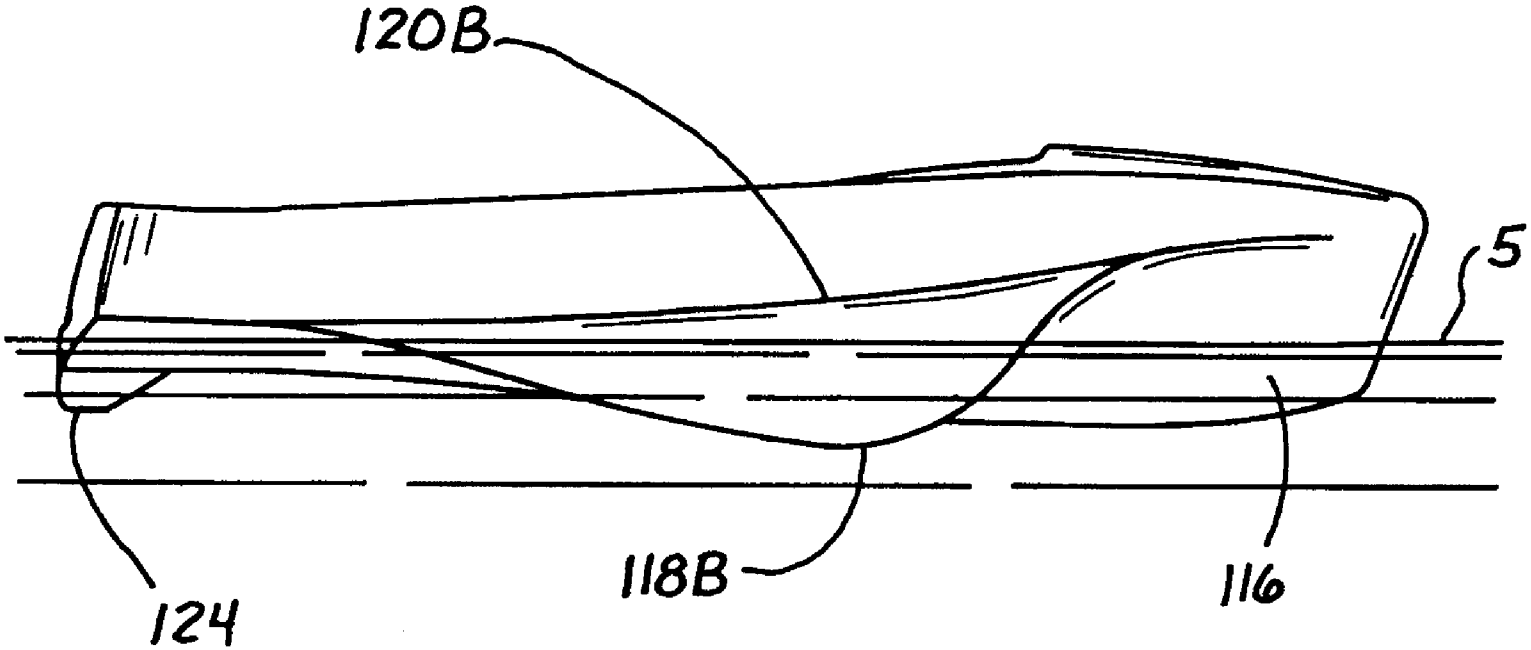
FIG. 5 shows a sailboat hull profile view designed according to the invention described in the great-grandparent patent application that issued as U.S. Pat. No. 6,250,245, depicting the central displacement body, planing wings and tapered outer skirts for side force and bow wave capture.
Figure 6A:
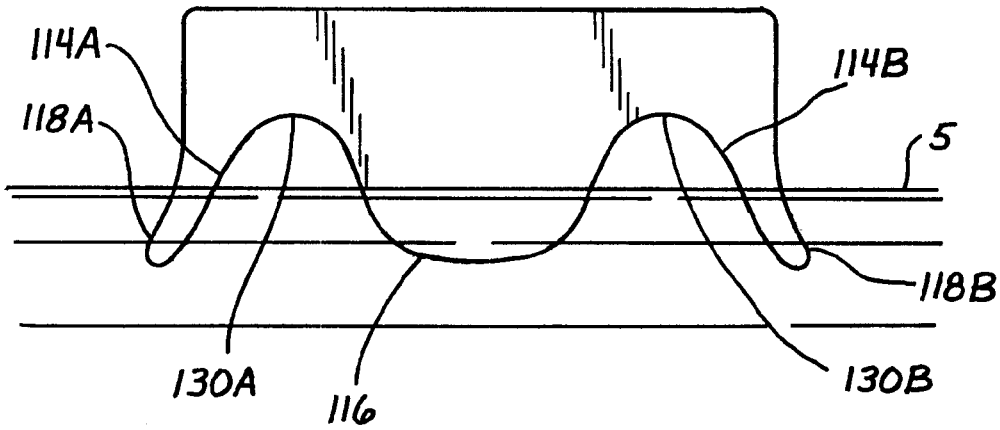
FIG. 6A shows the sailboat bow section depicting the wing channels, wing channel ceilings, central displacement body and skirts curved outwards at the tip to enhance side force.
Figure 6B:
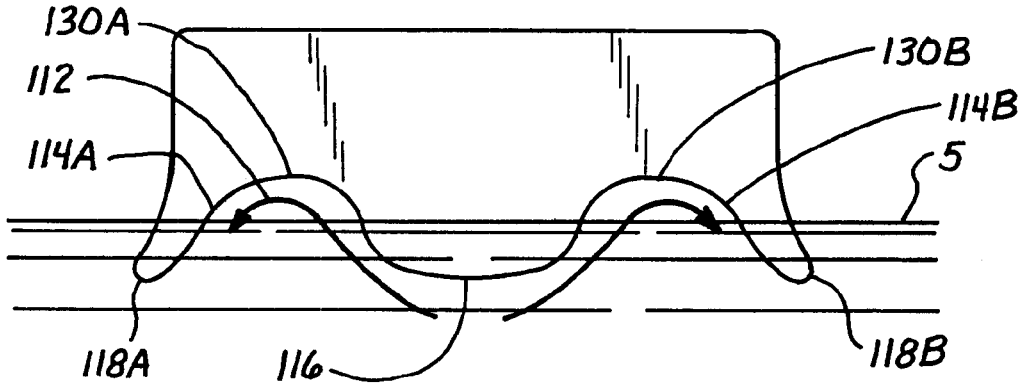
FIG. 6B shows the mid-section of the sailboat depicting the bow wave.
Figure 6C:
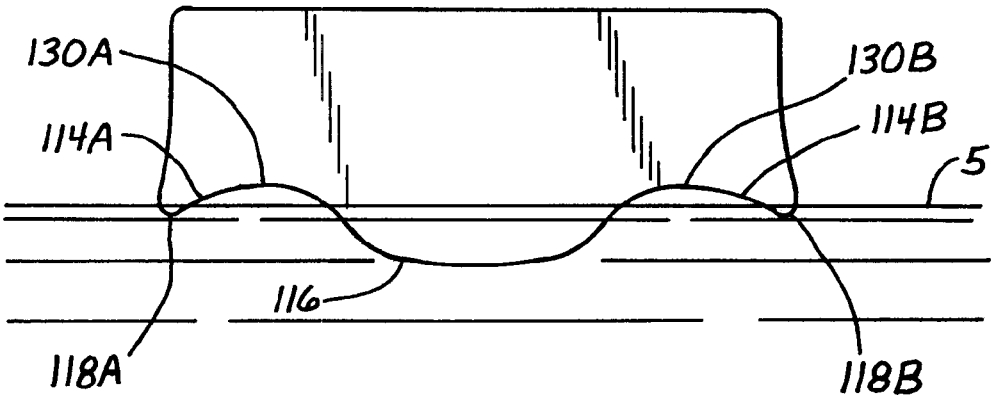
FIG. 6C shows the aft section of the sailboat.
Figure 7:
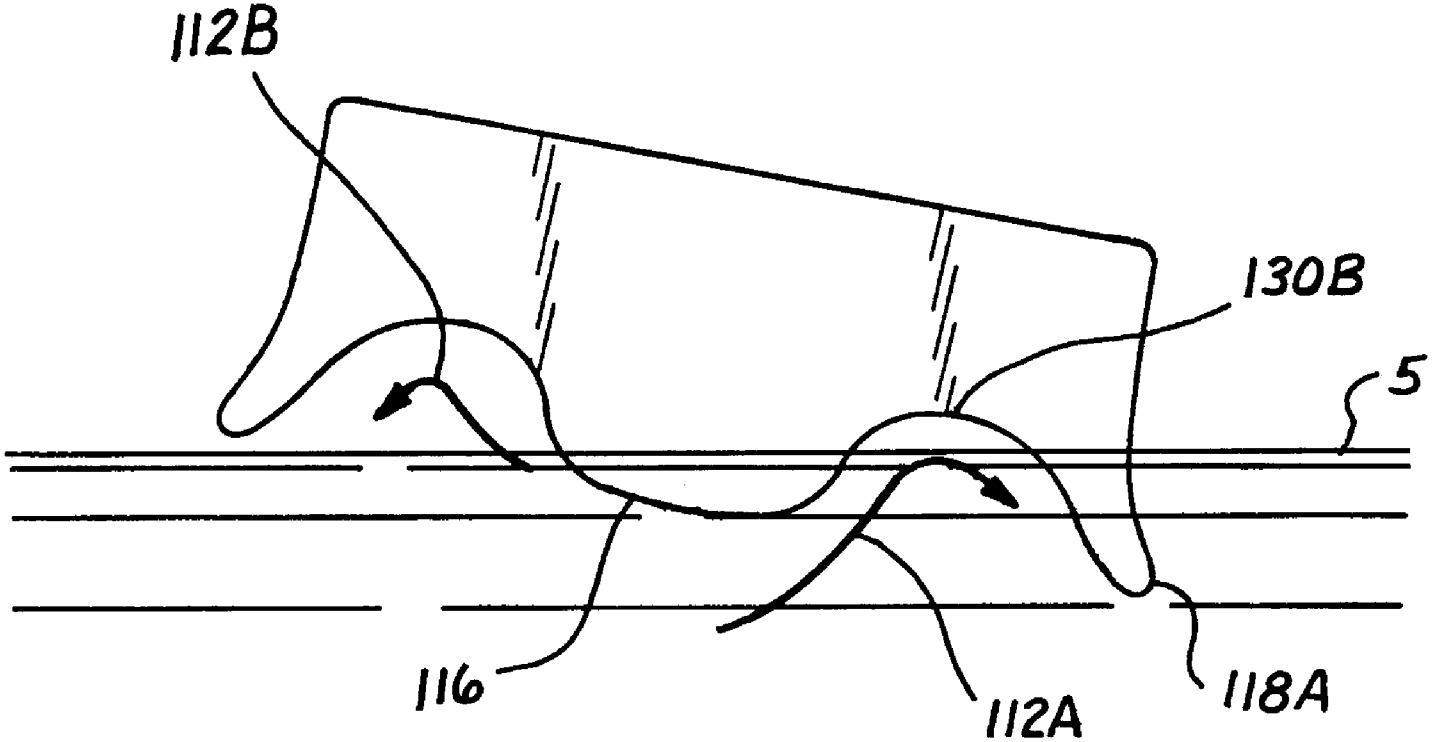
FIG. 7 shows the sailboat heeled mid-section, depicting the skirt increasing side force with heel, greater bow wave righting moment, and the lesser bow wave.

As mentioned above, the M-shaped hull design can also be adapted for use in a sailing vessel, as shown in FIGS. 4–7. A sailboat design incorporating an M-shaped hull 100 having a sailing mast 101 is illustrated in FIG. 4. Referring to FIGS. 4–7, such a sailboat has the following features:

1. A narrow displacement body 116 for efficient sailing at low speeds;
2. Planing wings 120A and 120B with ceilings 130A and 130B to provide stability from bow waves 112 (FIG. 6B) and to promote planing;
3. Righting moment from the lift on the lee-side bow wave 112*a* on the wing ceiling 130B, which increases with boat heel (lesser bow wave 112*b* and greater bow wave 112*a*, which increases the righting moment, are shown in FIG. 7);
4. Outer skirts 118A and 118B (preferably tapered) to contain the bow wave and provide automatic adjustment of side force with heel and increasing immersion of the skirt having a curved tip to enhance side force (see FIG. 7); and
5. Wing ceilings 130A and 130B sloped downward aft to the transom for efficient planing (see FIGS. 6A–C).

As with the powerboat embodiments described above, hydrodynamic serrations 124 may be mounted on the underside of the sailboat 100. As shown in FIGS. 6A–C, the wing channel ceilings 130A and 130B preferably decrease in height and the curvature of the wing channels 114A and 114B decreases, moving from the bow section (FIG. 6A) to the mid-section (FIG. 6B) to the aft section (FIG. 6C). As shown in FIG. 6C, the outer skirts 118A and 118B preferably decrease in length toward the aft end of the hull to provide efficient planing surfaces.

Figure 8:
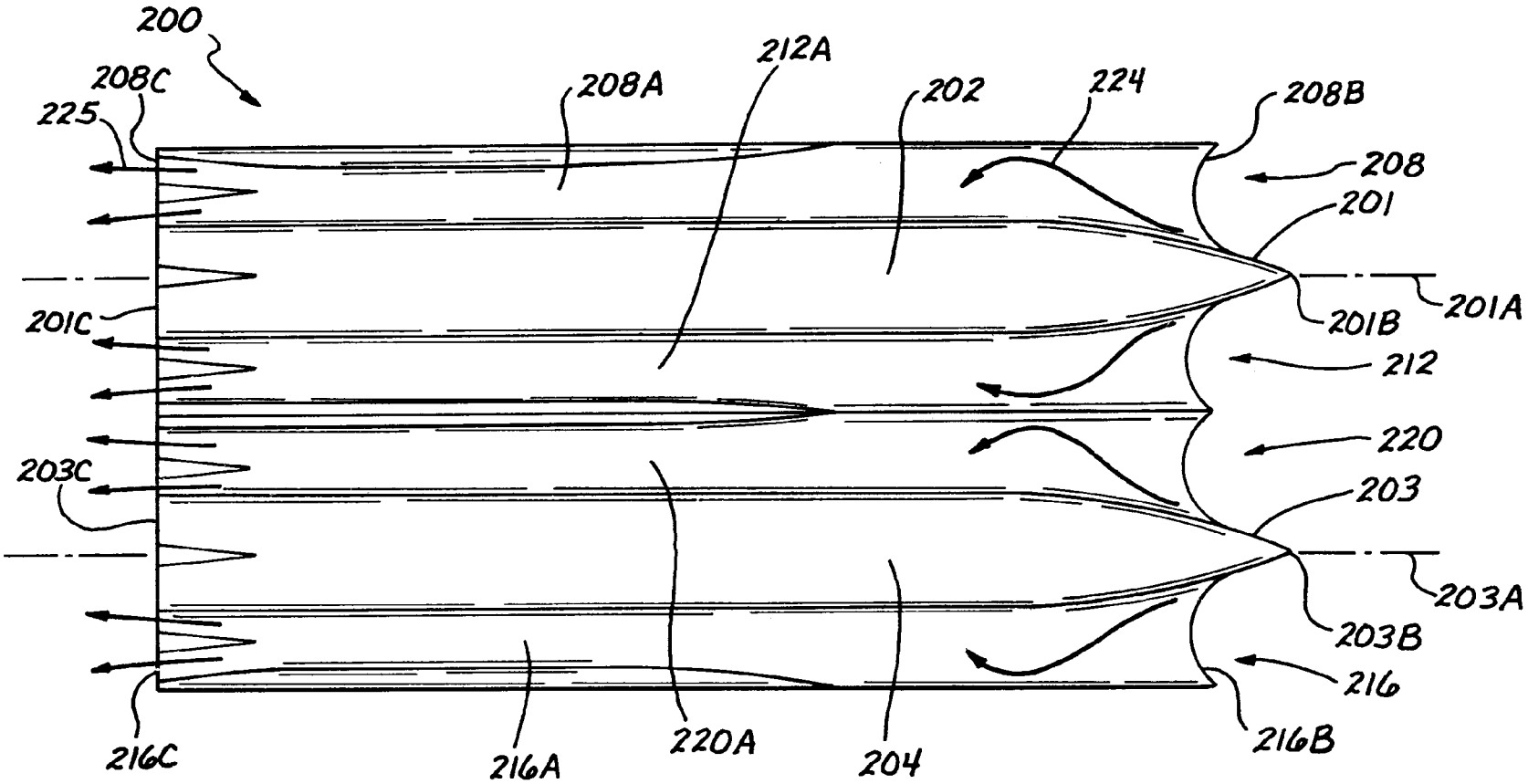
FIG. 8 shows a plan view of a twin-hull catamaran with multiple M-shaped hulls designed according to the invention described in the great-grandparent patent application that issued as U.S. Pat. No. 6,250,245, depicting large bow waves, small internal skirt waves, planing wings, spiral channel sections on the planing wings, two central displacement bodies, tapered outer and inner skirts, wing channels formed in the planing wings, and hydrodynamic serrations, both on the central displacement bodies and in the wing channels.
Figure 9:
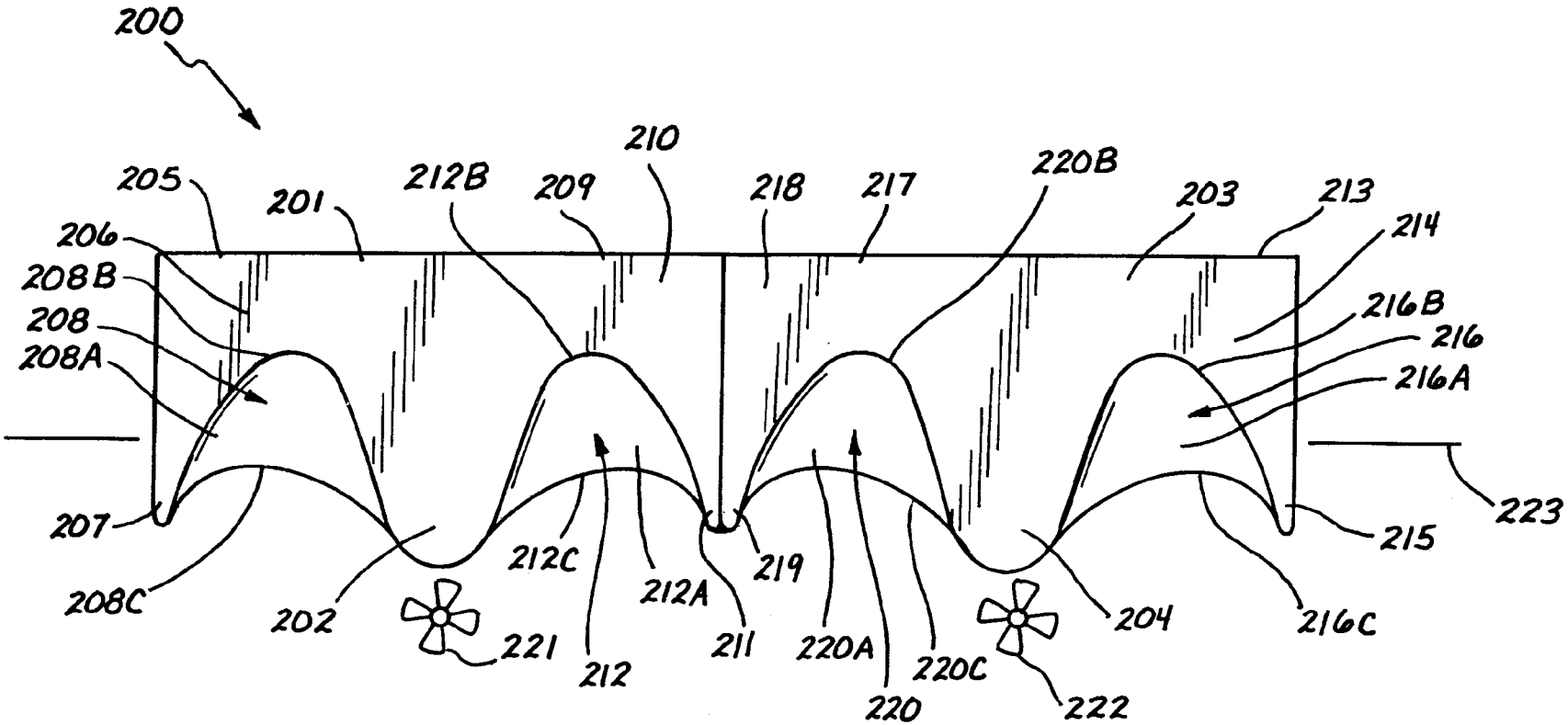
FIG. 9 shows an enlarged transverse section of the motored twin-hull catamaran with M-shaped hulls, depicting the two central displacement body portions, four wing channels, and tapered skirts that capture and suppress the bow waves; two propellers are shown, one mounted on each of the two central displacement bodies.

Multi-Hull M-Shaped Boat Hull. Referring now to FIGS. 8 and 9, they show a multi-hull watercraft in the form of a twin-hull catamaran 200 having two "M-shaped" hulls designed according to the invention described in the grandparent and great-grandparent applications that issued as U.S. Pat. Nos. 6,314,903 and 6,250,245. Although the catamaran 200 includes two M-shaped hulls, a multi-hull watercraft constructed according to the inventive concepts described in this section of the specification may have more than two hulls. The catamaran 200 includes a first hull 201 with a first displacement body 202 and a second hull 203 with a second displacement body 204. The first hull 201 extends along a first longitudinal axis 201A (FIG. 8) between a fore end 201B and an aft end 201C of the first hull, and the second hull 203 extends along a second longitudinal axis 203A between a fore end 203B and an aft end 203C of the second hull. Each of the hulls 201 and 203 is similar in many respects to the M-shaped hull 1 previously described, and so only differences are focused upon in the following description.

A first outboard channel-defining structure 205 (FIG. 9) that is part of the first hull 201 includes a first outboard wing 206 and a downwardly extending first outboard skirt 207 that cooperatively define a first outboard wing channel 208. As is apparent from FIGS. 8 and 9, these elements are "outboard" in the sense that the first outboard skirt 207 occupies a position disposed outwardly from the first displacement body 202 such that the first displacement body 202 is disposed intermediate the first outboard wing 207 and the second displacement body 204. A first inboard channel-defining structure 209 that is also part of the first hull 201 includes a first inboard wing 210 and a first inboard skirt 211 that cooperatively define a first inboard wing channel 212. These elements are "inboard" in the sense that the first inboard skirt 211 occupies a position disposed inwardly from the first displacement body 202 such that the first inboard skirt 211 is disposed intermediate the first displacement body 202 and the second displacement body 204.

Similarly, a second outboard channel-defining structure 213 that is part of the second hull 203 includes a second outboard wing 214 and a downwardly extending second outboard skirt 215 that cooperatively define a second outboard wing channel 216. These elements are "outboard" in the sense that the second outboard skirt 211 occupies a position disposed outwardly from the second displacement body 204 such that the second displacement body 204 is disposed intermediate the second outboard wing 207 and the first displacement body 202. A second inboard channel-defining structure 217 that is also part of the second hull 203 includes a second inboard wing 218 and a second inboard skirt 219 that cooperatively define a second inboard wing channel 220. These elements are "inboard" in the sense that the second inboard skirt 219 occupies a position disposed inwardly from the second displacement body 204 such that the second inboard skirt 219 is disposed intermediate the second displacement body 204 and the first displacement body 202.

The wing channel 208 includes a wing channel ceiling 208A that extends from a forward portion 208B of the wing channel ceiling to an aft portion 208C (FIGS. 8 and 9), and the wing channel 212 includes a wing channel ceiling 212A that extends from a forward portion 212B of the wing channel ceiling 212A to an aft portion 212C. Similarly, the wing channel 216 includes a wing channel ceiling 216A that extends from a forward portion 216B of the wing channel ceiling 216A to an aft portion 216C, and the wing channel 220 includes a wing channel ceiling 220A that extends from a forward portion 220B of the wing channel ceiling 220A to an aft portion 220C.

A first propeller 221 (FIG. 9) is mounted on the displacement body 202 and a second propeller 222 is mounted on the displacement body 204. Although the catamaran 200 is a motor powered watercraft, FIGS. 8 and 9 are intended to also illustrate germane aspects of a sail powered multi-hull watercraft. Reference numeral 223 designates the static waterline.

Thus, the catamaran 200 is a multi-hull watercraft (i.e., a watercraft having two or more hulls), each hull having a displacement body flanked by channel-defining structures that define wing channels and include downwardly extending skirts that capture bow waves and direct them spiraling rearward within the wing channels as previously described with reference to the single M-Shaped hull 1. In other words, the catamaran 200 has two M-shaped hulls and four arcuate channels adapted to contain the spiraling bow waves from the two central displacement bodies, thus to increase lateral stability and to suppress boat waves to protect nearby boats and structures at the water/land interface. This action is illustrated in FIG. 8 by arrows at the fore end of the catamaran 200 (one arrow 224 being designated) that depict incoming bow waves, and arrows at the aft end (one arrow 225 being designated) that depict energy-dissipated aerated water exiting the aft end of the wing channels.

High Speed M-Shaped Boat Hull. Next consider FIGS. 10–15.

They show a watercraft in the form of a powerboat 300 constructed according to the instant invention. Referred to as an "aero-planer," the powerboat 300 represents any of various types of powered watercraft, irrespective of their size and what they are called, including boats, ships, sea-going vessels, ferries, catamarans, and so forth that measure anywhere from less than 31 feet long to over 100 feet long. The powerboat 300 includes at least one M-shaped hull 301 in combination with various high speed performance enhancing features for high speed operation (i.e., aero-planing). It is illustrated at rest, with a bold line labeled DWL representing the datum water line.

Figure 10:
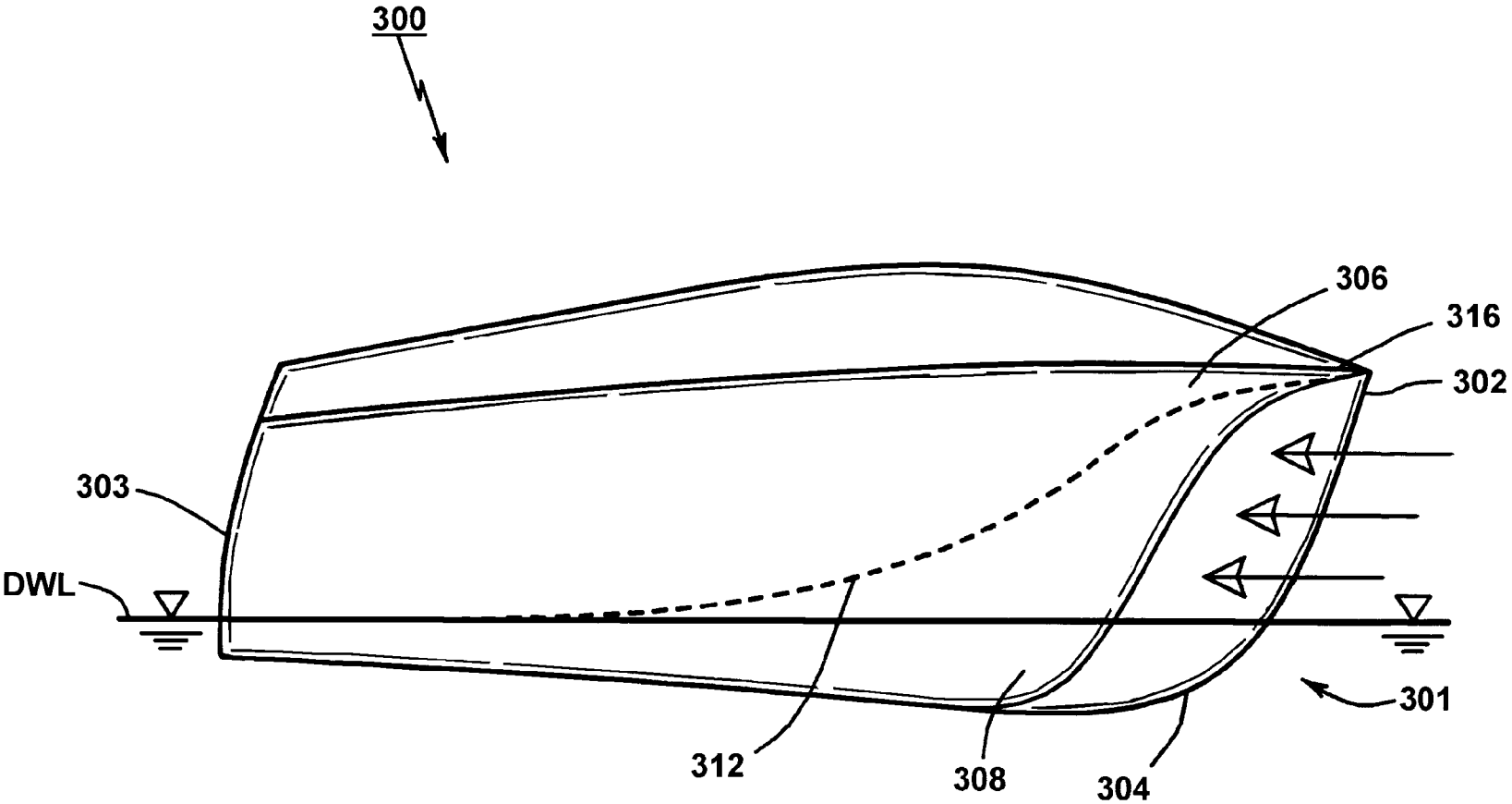
FIG. 10 is a profile of a high speed boat having a hull designed according to the invention described in the great-grandparent patent application that issued as U.S. Pat. No. 6,250,245 that is constructed according to the present invention for high speed operation.
Figure 11:
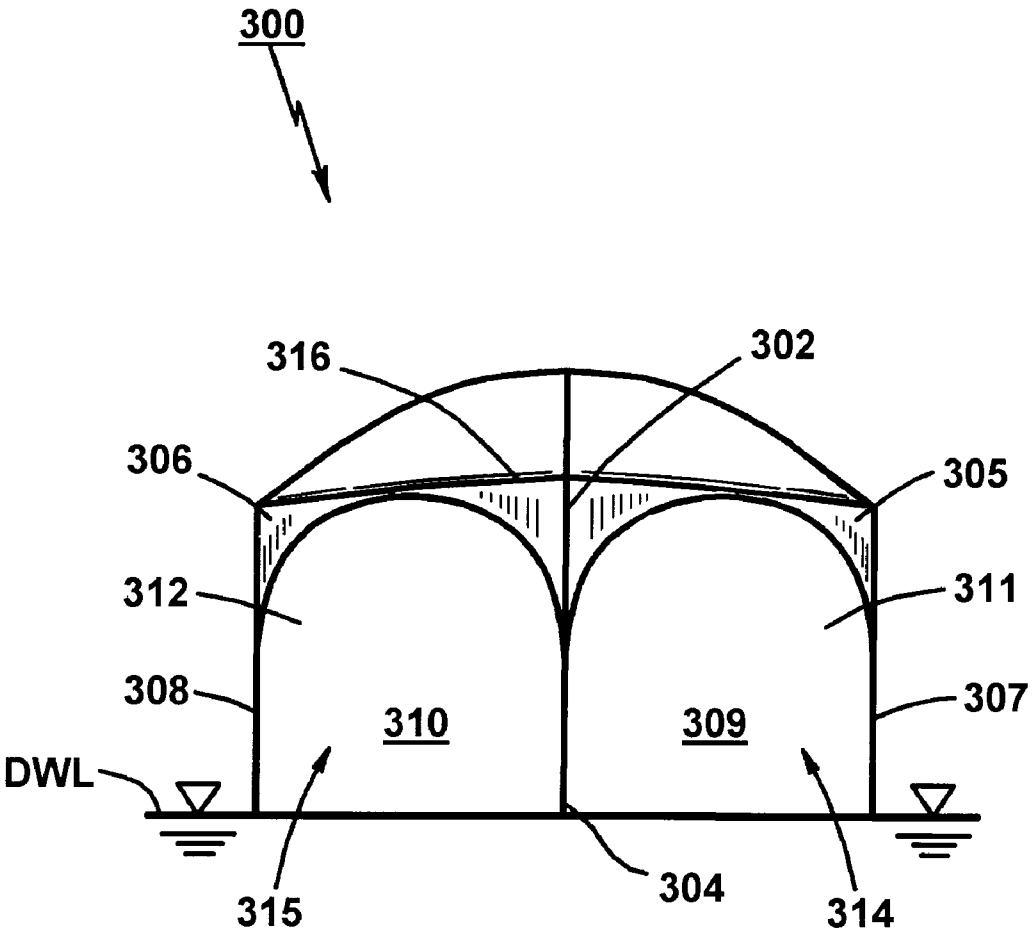
FIG. 11 is a front view of the high speed boat that shows the bow extended to a vertical knife edge and wing channel entrances expanded to form a near horizontal knife edge at the deck level.

Similar in some respects to the M-shaped hulls described earlier in this specification, specifically the hull 1 in FIGS. 1 and 2, the M-shaped hull 301 has a fore end 302, an aft end 303, and a displacement body 304 (FIG. 10). It includes port and starboard planing wings 305 and 306 (lateral extensions of the watercraft that extend outward from the central displacement body 304) and downwardly extending port and starboard skirts 307 and 308 (FIG. 11). The planing wings and skirts function as first and second channel-defining structures that define first and second (i.e., port and starboard) wing channels 309 and 310 (FIG. 11) that capture and channel bow waves rearwardly. A broken line 312 in FIG. 10 depicts the ceiling of the wing channel 310 (the ceiling of the wing channel 309 being similarly shaped), while reference numerals 311 and 312 identify port and starboard wing channel ceilings 311 and 312 in FIG. 11. Reference numerals 314 and 315 identifying forwardly facing port and starboard wing channel entrances 314 and 315. Details of those aspects of an M-shaped hull constructed according to the invention have all been described previously in this specification (e.g., the hull 1 in FIGS. 1 and 2 and the catamaran 200 in FIGS. 8 and 9). Those details apply to the watercraft 300 and so the focus of this description will now shift to the high speed performance enhancing aspects of the powerboat 300 illustrated diagrammatic in FIGS. 10–15.

FIGS. 10 and 11 show the hull geometry. The bow is configured to form the fore end 302 so that it is a forwardly facing vertical knife edge. In addition, the port and starboard wing channel entrances 314 and 315 are configured to maximize their cross sectional areas in order to thereby maximize the natural airflow into the wing channels 309 and 310 when the watercraft 300 moves forwardly under power (depicted by three arrows headed into the starboard wing channel in FIG. 10 and FIGS. 12–15). The height of the wing channel entrances 314 and 315 extends nearly to deck level to provide a nearly horizontal deck line 316 (FIGS. 10 and 11), although the ceilings 311 and 312 of the port and starboard wing channels 309 and 310 are arcuate in favor of the circular motion of the entering bow waves. This geometry not only increases the volume of entering air but also improves the aerodynamics, thereby reducing air resistance, and it improves the hydrodynamics at the bow 302 for wave piercing at high boat speeds.

FIGS. 12–15 show the powerboat 300 outfitted with various onboard air systems that are adapted to function as means for injecting air into the port and starboard wing channels 309 and 310. They introduce additional air into the port and starboard wing channels in order to enhance the air cushion in each wing channel and thereby enhance high speed operation and propulsion efficiency.

Figure 12:
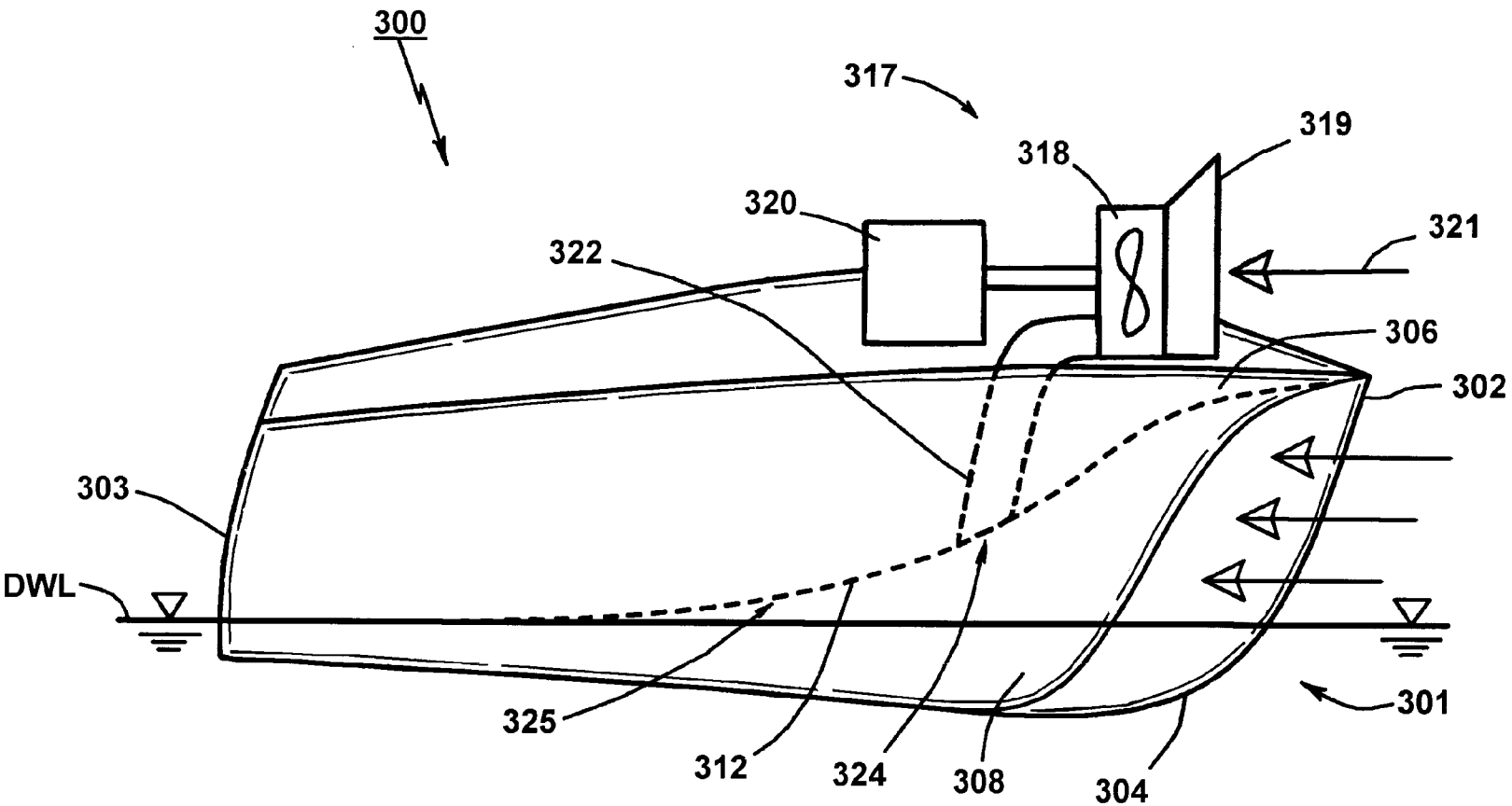
FIG. 12 is a diagrammatic representation of a first air system onboard the high speed boat that includes an auxiliary power unit and blower/compressor adapted to supply supplemental air under pressure through hose connections into the wing channels.

FIG. 12 shows the powerboat 300 outfitted with an air system 317 that includes an air blower 318 with a scoop inlet 319, and an on-deck auxiliary power unit 320 (e.g., a gasoline, diesel, or electrical unit that powers the air blower 318. Air entering the air scoop inlet 319, as depicted by a single arrow 321 in FIG. 12, is forced through suitable air ducting to the port and starboard wing channels 309 and 310 as depicted by an air duct 322 (e.g., a hose, pipe, tube, channel, or other conduit for the air). Only the starboard channel ceiling 312 is identified in FIG. 12 for illustrative convenience, but both channels, both ceilings, and both entrances are identified in FIG. 11. The air duct 322 and other components of the air system 317 are illustrated diagrammatically. The duct 322 is shown as introducing the supplemental air flow to a region along the starboard channel ceiling 312 identified by reference numeral 324, ahead of the air cushion 325 in the wing channel. Of course, the exact point of introduction can vary according to the design employed, and the air duct 322 introduces the supplemental air flow to the port wing channel in a similar manner also.

Figure 13:
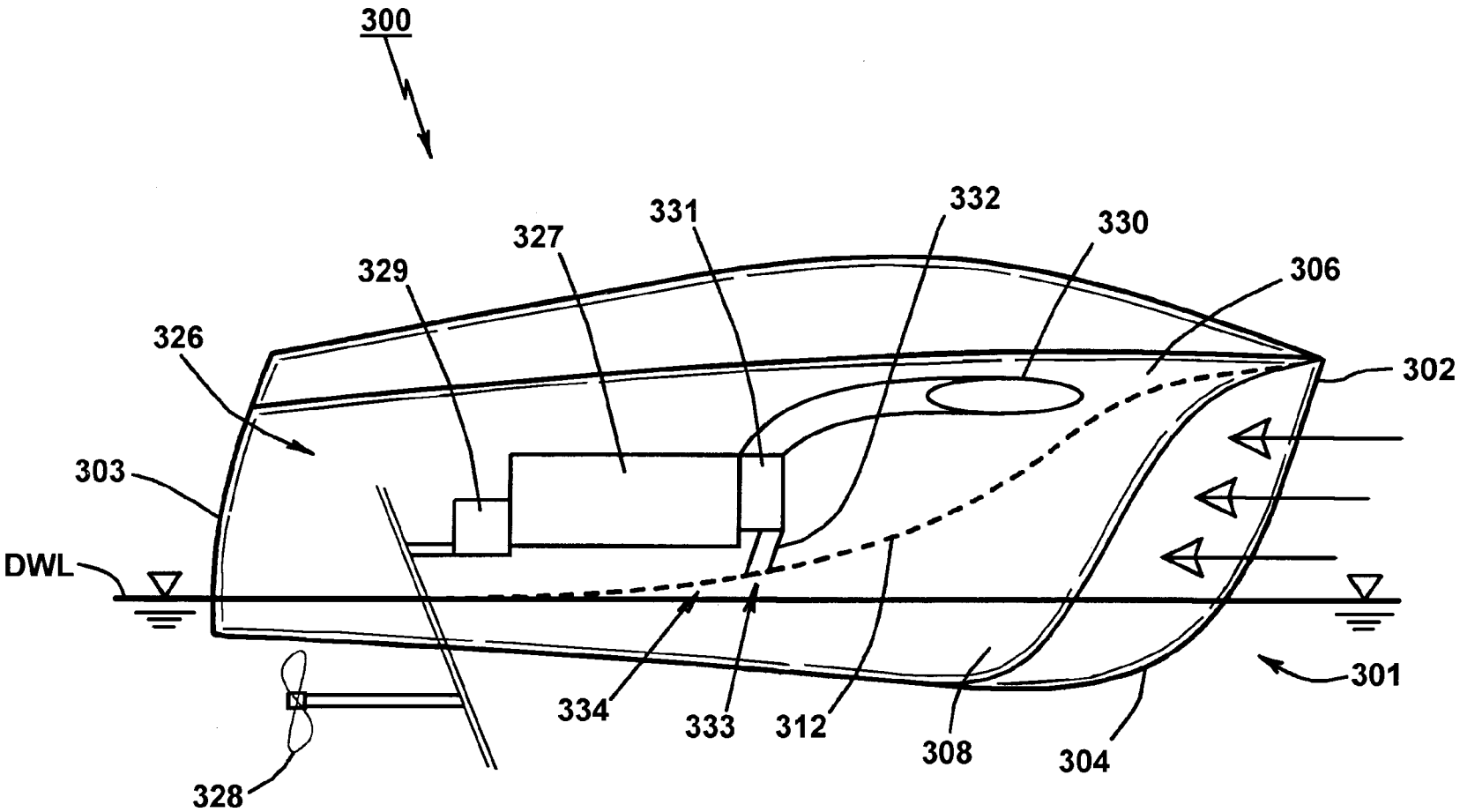
FIG. 13 is a diagrammatic representation of a second air system onboard the high speed boat that utilizes excess air from a main drive gas turbine to inject air into the wing channels.

FIG. 13 shows the powerboat 300 outfitted with another air system 326 that diverts excess air from a main drive gas turbine 327 that powers a propeller 328 via a reduction gear 329. Air flows into an air inlet 330 to a compressor 331, and a duct 332, or other suitable excess air diverting components, divert excess air to the wing channel. The duct 332 or other suitable excess air diverting components introduces the excess air to a region along the starboard channel ceiling 312 identified by reference numeral 333, ahead of the air cushion 334 in the wing channel.

Figure 14:
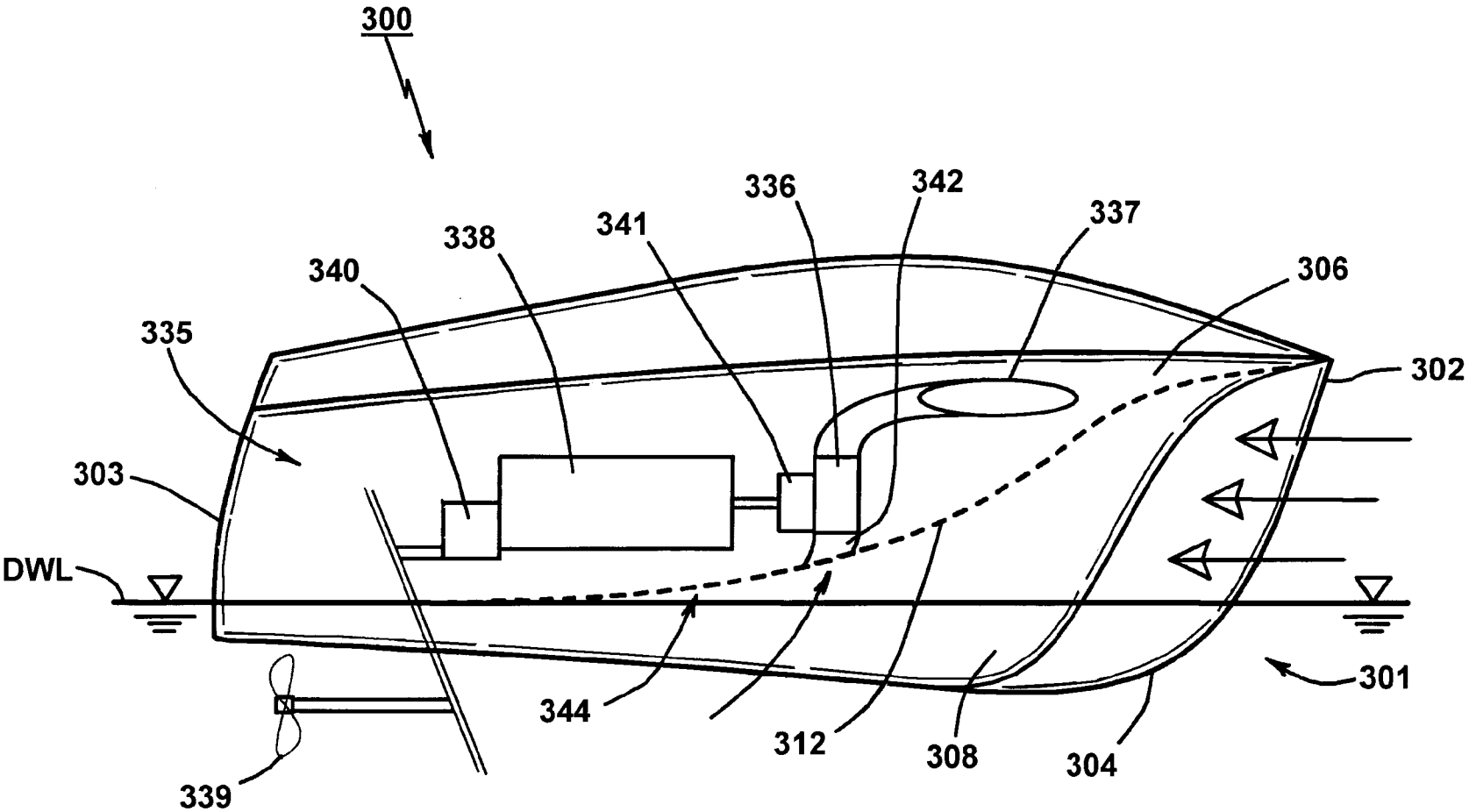
FIG. 14 is a diagrammatic representation of a third air system onboard the high speed boat that includes a blower driven off the main engine.

FIG. 14 shows the powerboat 300 outfitted with an air system 335 that includes a blower 336 having an air inlet 337. A diesel or gas turbine main engine 338 powers a propeller 339 via a reduction gear 340. The main engine 338 also powers the blower 336 via a blower drive gear 341. Air flows into air inlet 337 to the blower 336, and from there through a duct 342 to the wing channel. The duct 342 introduces the air to a region along the starboard channel ceiling 312 identified by reference numeral 343, ahead of the air cushion 344 in the wing channel.

Figure 15:
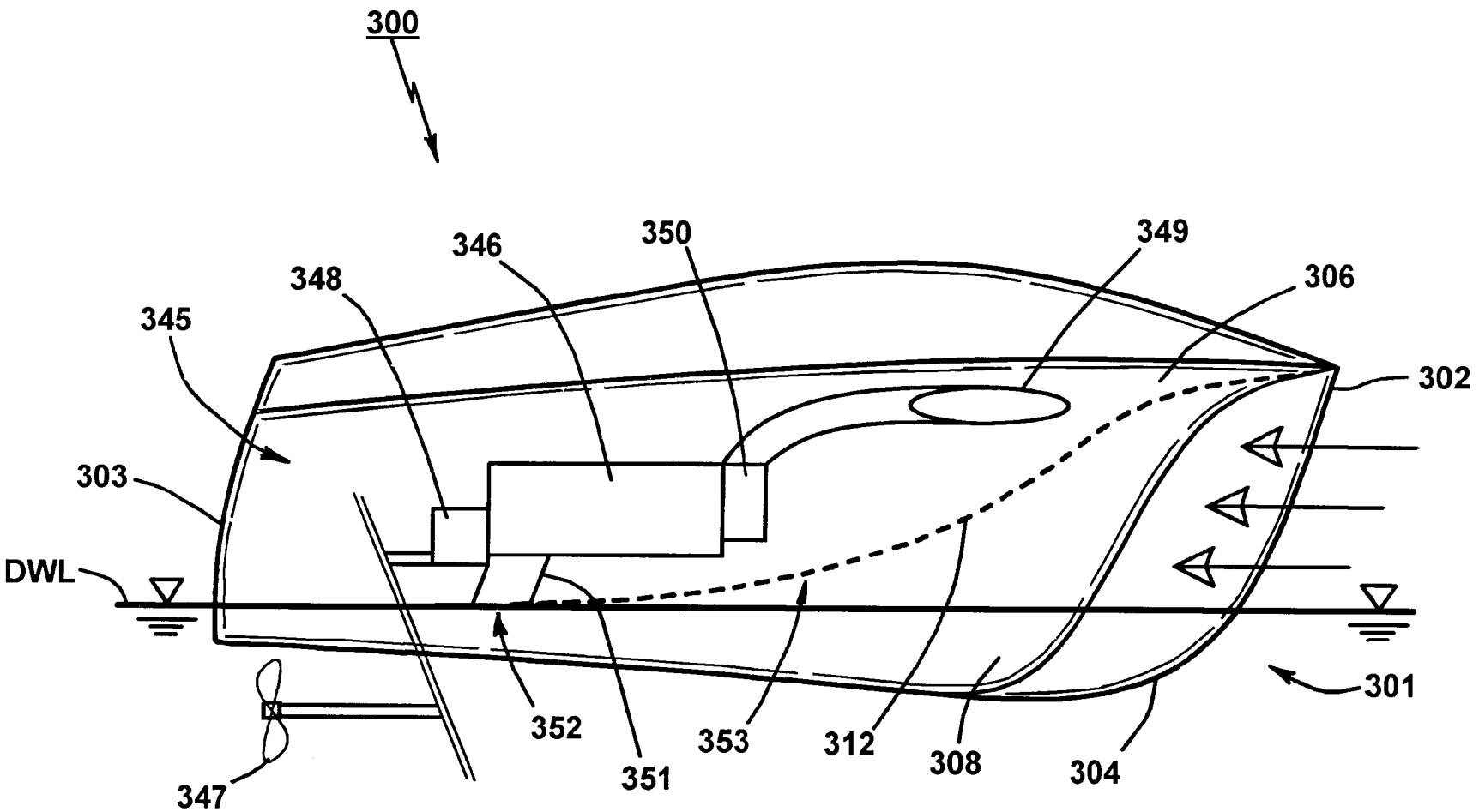
FIG. 15 is a diagrammatic representation of a fourth air system onboard the high speed boat that utilizes exhaust from a jet engine main drive.

FIG. 15 shows the powerboat 300 outfitted with an air system 345 that includes a jet engine main drive 346 that powers a propeller 347 via a reduction gear 348. Air flows in an air inlet 349 to a compressor 350 ahead of the jet engine main drive 346. Jet engine exhaust flows from the jet engine main drive 346 through a duct 351, or other suitable exhaust-diverting component, to the wing channel. The duct 351 (other exhaust-diverting component) introduces the air to a region along the starboard channel ceiling 312 identified by reference numeral 352, rearward of the air cushion 353 in the wing channel.

Thus, the invention provides a watercraft having at least one M-shaped hull in combination with geometry and supplemental air components that significantly enhance high speed operation and propulsion efficiency. For high speed operations of multi-hull vessels, such as shown in FIGS. 8 and 9, two or more M-shaped hulls are joined in parallel at the outer skirts to form a single common interior skirt. The aerated water pressure is equal on each side of the common skirt and so the common skirt needs only to extend down to the operating water line to preserve the spiraling of the two bow waves. Eliminating submergence of this common skirt below the water line reduces friction drag to enhance high speed performance. Based upon the foregoing description, one of ordinary skill in the art can readily implement the invention in any of various forms of watercraft, and the scope of the claims is intended to include watercraft having more than one M-shaped hull. Although exemplary embodiments have been shown and described, one of ordinary skill in the art may make many changes, modifications, and substitutions without necessarily departing from the spirit and scope of the invention.

What is claimed is:

1. A watercraft, comprising:

a hull having a fore end, an aft end, and a longitudinal axis extending between the fore end and the aft end;

a displacement body portion of the hull that extends between the fore end and the aft end, the displacement body having a static waterline, a port side, and a starboard side;

a first channel-defining structure portion of the hull that is located on the port side of the displacement body, including a first wing structure extending laterally from the port side of the displacement body above the static waterline and a first outer skirt structure that extends downwardly from the first wing structure to below the static waterline in spaced apart relationship to the displacement body, said first outer skirt structure having an outer surface that is substantially perpendicular with respect to the static waterline and said first channel-defining structure defining a first channel with a cross-sectional surface that is generally arcuate; and a second channel-defining structure portion of the hull that is located on the starboard side of the displacement body, including a second wing structure extending laterally from the starboard side of the displacement body above the static waterline and a second outer skirt structure extending perpendicularly downwardly from the second wing structure to below the static waterline in spaced apart relationship to the displacement body, said second outer skirt structure having an outer surface that is substantially perpendicular with respect to the static waterline and said second channel-defining structure defining a second channel with a cross-sectional surface that is generally arcuate;

the first and second channels extending from the fore end to the aft end and the first and second channels being adapted to capture a bow wave and to cause air and water to mix and spiral toward the aft end of the hull as compressed aerated water, thereby reducing friction drag, increasing lateral stability, and dampening transmission of bow wave energy at the aft end of the hull;

wherein the hull extends to a vertical knife edge and the first and second channels include first and second wing channel entrances that form a near horizontal knife edge at the deck level in order to achieve maximum air flow into the first and wing channels when the watercraft is moving forwardly in order to enhance high speed operation of the watercraft.

2. A watercraft as recited in claim 1, further comprising an onboard air system that is adapted to function as means for injecting air into the first and second channels in order to enhance high speed operation of the watercraft.

3. A watercraft as recited in claim 2, wherein the onboard air system includes an air blower and an auxiliary power unit arranged to power the air blower.

4. A watercraft as recited in claim 2, wherein the watercraft includes a main drive gas turbine, and the onboard air system includes components for diverting excess air from the main drive gas turbine to the first and second channels.

5. A watercraft as recited in claim 2, wherein the watercraft includes a main drive motor, and the onboard air system includes an air blower powered by the main drive motor.

6. A watercraft as recited in claim 2, wherein the watercraft includes a jet engine main drive, and the onboard air system includes components for diverting exhaust from the jet engine main drive to the first and second channels.

7. A watercraft, comprising:

at least one hull having a fore end, an aft end, and a longitudinal axis extending between the fore end and the aft end;

a displacement body portion of the hull that extends between the fore end and the aft end, the displacement body having a static waterline, a port side, and a starboard side;

a first channel-defining structure portion of the hull that is located on the port side of the displacement body, including a first wing structure extending laterally from the port side of the displacement body above the static waterline and a first outer skirt structure that extends downwardly from the first wing structure to below the static waterline in spaced apart relationship to the displacement body, said first outer skirt structure having an outer surface that is substantially perpendicular with respect to the static waterline and said first channel-defining structure defining a first channel with a cross-sectional surface that is generally arcuate; and a second channel-defining structure portion of the hull that is located on the starboard side of the displacement body, including a second wing structure extending laterally from the starboard side of the displacement body above the static waterline and a second outer skirt structure extending perpendicularly downwardly from the second wing structure to below the static waterline in spaced apart relationship to the displacement body, said second outer skirt structure having an outer surface that is substantially perpendicular with respect to the static waterline and said second channel-defining structure defining a second channel with a cross-sectional surface that is generally arcuate;

the first and second channels extending from the fore end to the aft end and the first and second channels being adapted to capture a bow wave and to cause air and water to mix and spiral toward the aft end of the hull as compressed aerated water, thereby reducing friction drag, increasing lateral stability, and dampening transmission of bow wave energy at the aft end of the hull;

wherein the watercraft includes an onboard air system that is adapted to function as means for injecting air into the first and second channels in order to enhance high speed operation of the watercraft.

8. A watercraft as recited in claim 7, wherein the onboard air system includes an air blower and an auxiliary power unit arranged to power the air blower.

9. A watercraft as recited in claim 7, wherein the watercraft includes a main drive gas turbine, and the onboard air system includes components for diverting excess air from the main drive gas turbine to the first and second channels.

10. A watercraft as recited in claim 7, wherein the watercraft includes a main drive motor, and the onboard air system includes an air blower powered by the main drive motor.

11. A watercraft as recited in claim 7, wherein the watercraft includes a jet engine main drive, and the onboard air system includes components for diverting exhaust from the jet engine main drive to the first and second channels.

12. A watercraft, comprising:

at least one hull having a displacement body with a bow, a port side, and a starboard side;

a first channel-defining structure portion of the hull that is located on the port side of the displacement body, including a first wing structure extending laterally from the port side of the displacement body above the static waterline and a first outer skirt structure extending perpendicularly downwardly from the first wing structure to below the static waterline in spaced apart relationship to the displacement body, said first outer skirt structure having an outer surface that is substantially perpendicular with respect to the static waterline and said first channel-defining structure defining a first channel with a cross-sectional surface that is generally arcuate; and a second channel-defining structure portion of the hull that is located on the starboard side of the displacement body, including a second wing structure extending laterally from the starboard side of the displacement body above the static waterline and a second outer skirt structure extending perpendicularly downwardly from the second wing structure to below the static waterline in spaced apart relationship to the displacement body, said second outer skirt structure having an outer surface that is substantially perpendicular with respect to the static waterline and said second channel-defining structure defining a second channel with a cross-sectional surface that is generally arcuate;

the first and second channels being adapted to function as (i) means for directing waves generated by the bow into the first and second channels, so as to reduce lateral wave pollution from the watercraft, (ii) planing means for providing surfaces on which the watercraft is capable of planing on the waves generated by the bow, so as to recapture energy from said bow waves, and (iii) means for aerating water along the hull to reduce frictional drag and to reduce wave generation from an aft end of the watercraft; and an onboard air system that is adapted to function as means for injecting air into the first and second channels in order to enhance high speed operation of the watercraft.

13. A watercraft, comprising:

at least one hull having a displacement body with a bow, a port side, a starboard side, and a deck level;

a first channel-defining structure portion of the hull that is located on the port side of the displacement body, including a first wing structure extending laterally from the port side of the displacement body above the static waterline and a first outer skirt structure extending perpendicularly downwardly from the first wing structure to below the static waterline in spaced apart relationship to the displacement body, said first outer skirt structure having an outer surface that is substantially perpendicular with respect to the static waterline and said first channel-defining structure defining a first channel with a cross-sectional surface that is generally arcuate; and a second channel-defining structure portion of the hull that is located on the starboard side of the displacement body, including a second wing structure extending laterally from the starboard side of the displacement body above the static waterline and a second outer skirt structure extending perpendicularly downwardly from the second wing structure to below the static waterline in spaced apart relationship to the displacement body, said second outer skirt structure having an outer surface that is substantially perpendicular with respect to the static waterline and said second channel-defining structure defining a second channel with a cross-sectional surface that is generally arcuate;

the first and second channels being adapted to function as (i) means for directing waves generated by the bow into the first and second channels, so as to reduce lateral wave pollution from the watercraft, (ii) planing means for providing surfaces on which the watercraft is capable of planing on the waves generated by the bow, so as to recapture energy from said bow waves, and (iii) means for aerating water along the hull to reduce frictional drag and to reduce wave generation from an aft end of the watercraft;

the bow extending to a vertical knife edge; and the first and second wing channel entrances being arranged to form a near horizontal knife edge at the deck level;

thereby to achieve maximum air flow into the first and second channels when the watercraft is moving forwardly in order to enhance high speed operation of the watercraft.

* * * * *